United States Patent [19]

Kahn

[11] 4,072,312

[45] Feb. 7, 1978

[54] TENNIS RACQUET HANDLE CONSTRUCTIONS

[76] Inventor: Benjamin Kahn, 1605 Michigan Ave., Miami Beach, Fla. 33139

[21] Appl. No.: 650,689

[22] Filed: Jan. 20, 1976

[51] Int. Cl.[2] ..... A63B 49/08

[52] U.S. Cl. ..... 273/75

[58] Field of Search ..... 273/73 R, 73 C, 73 J, 273/75, 81.4–81.6, 81 R, 81 B

[56] References Cited

U.S. PATENT DOCUMENTS

| | | | |
|---|---|---|---|
| 346,858 | 8/1886 | Moss | 273/75 |
| 739,450 | 9/1903 | Schnek | 273/75 X |
| 1,046,562 | 12/1912 | Curley | 273/75 X |
| 1,506,523 | 8/1924 | Gordon | 273/81.4 |
| 1,532,822 | 4/1925 | Kemp | 273/75 X |
| 1,539,029 | 5/1925 | Surridge | 273/73 J |
| 2,097,616 | 11/1937 | Davis | 273/73 J |
| 2,201,263 | 5/1940 | Hall | 273/73 J |
| 3,848,871 | 11/1974 | Sweet et al. | 273/75 |
| 3,868,110 | 2/1975 | Jones | 273/75 |
| 4,006,896 | 2/1977 | Soldavini | 273/75 X |

FOREIGN PATENT DOCUMENTS

| | | | |
|---|---|---|---|
| 20,912 | 8/1905 | Austria | 273/75 |
| 858,205 | 5/1940 | France | 273/75 |
| 170,717 | 11/1921 | United Kingdom | 273/73 J |
| 600,845 | 4/1948 | United Kingdom | 273/75 |
| 211,792 | 2/1924 | United Kingdom | 273/75 |
| 407,270 | 3/1934 | United Kingdom | 273/75 |

*Primary Examiner*—Richard J. Apley

[57] ABSTRACT

A handle construction for racquets having opposing, flat ball-striking playing faces wherein the handle is of substantially octagonal outline of varying sized opposing surfaces, one pair of which are parallel to the playing faces of the racquet, the size variation between these opposing surfaces and other pairs of opposing surfaces among the composite surfaces of the handle are different to the degree that they are sensorially perceptive by sense of feel transmitted by impression gained only in the hand grip of the player without other observation. The determination of these surfaces involved at one or more of the corners of the handle's sectional outline is intensified to be more acute to the feel than the ordinary corner of a handle of normally octagonal outline of 135° and more acute than nonrecessed or other corners, as to provide extra sensory perception felt through the player's grip only, as to the disposition of the playing faces throughout an entire swing of the racquet without prior or instant observation or other prior orientative discernment. A handle construction of tennis racquet character having extra sensory perception incorporated in the handle's perimeter surfaces as to their composite differences in size, shape and intensification of the corners or other elements comprising its cross-sectional outline including its girth and diametrical dimensional differences among the opposing pairs of surfaces.

9 Claims, 13 Drawing Figures

TENNIS RACQUET HANDLE CONSTRUCTIONS

FIELD OF INVENTION

This invention relates to racquets such as tennis racquets and the like and more particularly to the handles of such racquets.

Still more particularly this invention is related to the construction and cross-sectional outline configurations of such handles of octagonal character that include opposing pairs of parallel faces parallel to and right angles to the plane of the ball-striking surfaces of the head of the racquet.

The invention further relates to extra sensory perception provisions impressible involuntarily into the mind of the player imparted through the intensification factors sensed by mere gripping of the handle.

OBJECTS OF INVENTION

The principal object of the invention is to provide such above mentioned types of handles with an improved hand-grasp feel with high sense-transmission capabilities that increases the players awareness and retentivity as to the orientative disposition of the racquet head without his looking at or touching the racquet with his other hand.

Another object is to provide a tennis racquet handle of octagonal outline in cross-section in standard sizes and perimetrical dimensions comprised of sensibly different composite contiguous surfaces whereby orientation of the handle and the head of the racquet are more readily determinable.

Still another object is to improve the users playing ability by providing means on the handle, within the players grip whereby, through intensive impressionable feeling persisting throught his swing, the need for retaining orientation information impression obtained by means other than the feel in his grip is obviated and involuntary orientation impressed by the grip of the handle, persists throughout the entire swing of the racquet, relieving the player of the mental carry over.

Other objects and advantages will appear in the following specification and accompanying drawing showing and describing several preferred forms embracing the principles of the invention defined in the claims.

PRIOR ART

Most tennis racquets have had, and still have handles, of octagonal cross-section. The composite surfaces of the handle are substantially of equal perimetrical width except the two opposing surfaces in the plane of the head of the racquet, which are slightly wider. This difference is barely discernable by the grip of the player and, as a result, the orientation of the racquet is generally determined by sensed intelligence obtained by means such means as visible notice or by feel of the head with other than the gripping hand which information is however brief, carried across the the swing. This mental operation occurs after the player removes his eyes or other hand from the racquet.

Such above mentioned racquet handles come in prescribed grip sizes identified in the trade as "small", "medium", and "large". The corresponding perimetrical dimensions are, respectively about four and one-eighth inches, ($4\frac{1}{8}$ inches); about four and seven-sixteenths, (4 7/16 inches); and about four and three quarters ($4\frac{3}{4}$ inches). However, while the width dimensions of corresponding composite surfaces varies in accordance with the grip sizes, in any given size, the relationship of the width sizes of its composite surfaces remains about the same, and that is that the two transvrse surfaces and the four diagonal surfaces are substantially of the same width and of dimension slightly smaller than the two opposing surfaces in the plane of the head of the racquet. The larger dimension being about $1\frac{1}{8}$th larger than the smaller diagonal and transverse surfaces. Stating this another way; the smaller widths surfaces are about 90% of the width of the larger.

Of the eight surfaces comprising the gripping contact areas, six are substantially alike and the only discernment, by feel alone, is to identify by sense perception determination of the location of one of the larger surfaces in the palm, or in the grip as the case may be. It is to be realized that only one of the larger surfaces can be in the palm, the other opposite one, being at any time, in the sensing range of the fingers at or near the fingertips.

Circumscribing a substantially standard tennis racquet handle in terms of small and large surfaces subject to feel of the player, and starting at the corner juncture of the angulated diagonal surface and a large surface, one feels, a small, small, small, large, small, small, small, large; a preponderance feeling of small, same-sized surfaces, difficult to distinguish by grip feel alone. To establish the necessary orientation, without looking, is the reason why players touch the racquet with the other hand however unconcious and involuntary this action pattern appears to be in play.

All edges formed at the junctures of the of the adjacent surfaces at 45° from each other form an obtuse edge between them of 135°, included angle. With covering material usually spirally wrapped around the handle, hard blunt edges are presented to the grip of the player. These blunt edges are the only means whereby the player is able to sensibly perceive the width of the surfaces of the handle. in order to distinguish large width surfaces from the small ones for good orientative discernment of the disposition of the head. It is solely the felt distance relationship of the edges that signals the head disposition to the brain of the player, that is, without prior looking or feeling of the head or neck of the racquet prior to and during the swing. Therefore, any increase in acuteness of the edges increases the intensity and duration of the impressed feel-signals.

BRIEF DESCRIPTION OF DRAWING

Referring to FIG. 1, the racquet shown is typical of a strung tennis racquet having a frame-like head 10, within which the strings form the playing faces 12 on opposite sides thereof. A neck portion 14 extends from the frame in the plane of the head. Coextensive with the neck is a handle 16, of octagonal-like character, that is, eight contiguous surfaces comprise the perimeter of the handle. Pliant material generally covers these surfaces as at 18.

In other ball-striking sport the construction of the head may be solid or perforate, and the neck may be absent where an octagonal-like handle is secured to the head such as in ping-pong or paddle tennis. The common provisions in such racquets are the opposed playing faces and an octagonal-like handle in the plane of the playing faces.

Figure 1:
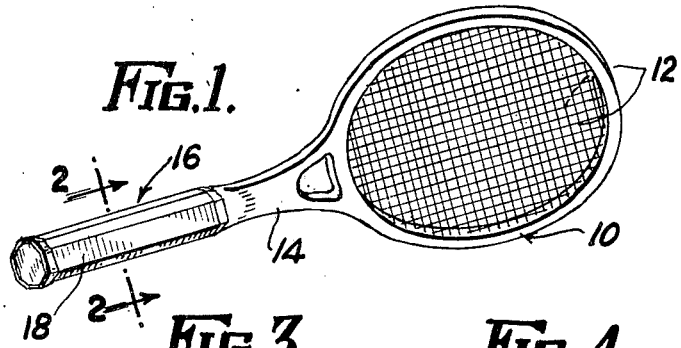
FIG. 1 is a perspective view of a tennis racquet of the octagonal handle character embracing the invention.
Figure 2:
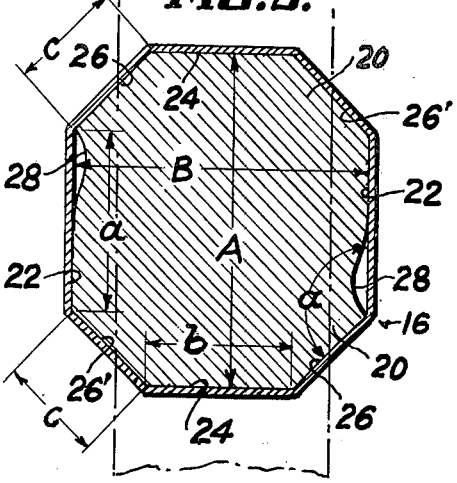
FIG. 2 is a simplified cross-sectional view of the handle in FIG. 1 taken on line 2—2, and showing a covering layer around the periphery outline of the handle.

Referring to FIG. 2, the covered handle 20 is composed of four pairs of parallel opposed surfaces of which the pair 22 are parallel to the plane of the playing faces of the head of the racquet as indicated by the dot and dash lines. The pair of surfaces 24 are at right angles to the surfaces 22. The two pairs of parallel opposing surfaces 26, 26′ are diagonally disposed with respect to the surfaces 22 and 24, thus forming edges between adjacent surfaces. It is to be noticed that *c*, distance between the edges defining the diagonal surfaces are substantially the same and smaller than that of edge to edge *b* distances along the surfaces 24. It is also to be noticed that distances *a* are greater than the distances *b*. Circumscribing the outline cross-section of this handle construction in terms of successive widths of its sufaces subject to the feel of the player, and, starting at the juncture of the angulated diagonal small width surface one feels a small, medium, small, large, small, medium, small, and large. The small surfaces are not felt in neither triple or double succession as in the above described prior art racquet handles.

Of the eight surfaces comprising the construction of the handle of FIG. 2, the discernment by feel along to sense perceive the relative size and locations of the several varying widths surfaces by the feel in the palm and roots of the fingers is greatly improved over the constructions prevailing in the prior art having a succession of adjacent similar sized surfaces.

Some players are sensitive to the overall oblong aspect feel of the handle. The major components to this aspect is the ratio of the transverse dimension A to its transverse dimension B. These players take a handshake-like grip on the handle for emphasis.

In order to increase and further intensify the sense-perceptivity of the handle of FIG. 2, to the grip of the player, undercuts as at 28 on the larger surface at diametrically opposite places along one edge, are provided. One edge of the undercut, longitudinally, is coincident with the edge of the adjacent diagonal surface 26 or 26′ as the case may be. Some left or right-handed persons prefer the undercut along the 26′ edges.

Figure 3:
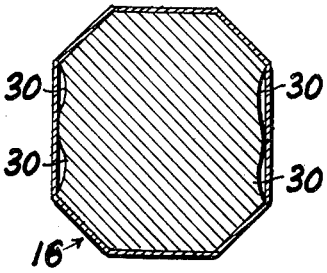
FIG. 3 is a similar view like FIG. 2, of a modified form of the invention.

This construction provides an edge, sharper than the standard 135° at these longitudinal places and it can be readily observed that at this zone an "acuteness-of-edge" in the order of 90° at $\alpha$ (alpha) is readily obtainable, without undue strain on the cover or attrition to the palm of the player. Double undercuts of relatively shallow chordal depth as at 30, 30 on each of the large surface of the handle construction of FIG. 3, provides increased acuteness to the sensitivity of feel at four distinctive places which serve as sense perceptive means regarding orientative intelligence via sensory transmission, and high involuntary retentivity.

Figure 4:
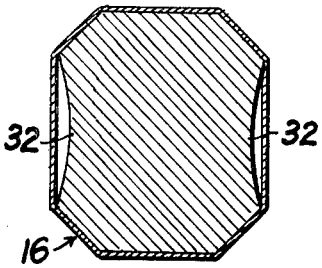
FIG. 4 is another similar view like FIG. 2 of another modified form of the invention.

Referring to FIG. 4, for players who are palm sensitive, have delicate sense of feel, or a sharp or keen sense of deteminabilty through feel stimuli relating to orientativeness, shallow chordal recesses or flutes 32 will suffice to improve his game by only slight accentuation of the shown four edges along the the larger surfaces of the handle.

It can be readily seen that this type of undercut, scalloping or flutes that produces or increases the acuteness of the edges may be employed in any pair of diametrically opposing parallel surfaces of the handle or in all of the eight surfaces of the octagonal outline of the tennis racquet handle with a degree of increased sensory perception over blunt 135° subtended edges. The added feature of sensible variations of spacing among the composite edges further increases the sensitivity of feel transmittable through the players grip upon the handle.

The oblong aspect ratio of the standard racquets in the standard grip sizes of Small ($4\frac{1}{8}$ inches perimeter), Medium (4 7/16 inches perimeter) and Large ($4\frac{3}{4}$ inches perimeter) is very close to the ratio of the distances B to A which expressed in terms of percentage is 1 to $1\frac{1}{8}$, i.e. numerically 1.00/1.125 which is 90%. This percentage oblong aspect ratio prevails in all grip sizes. The oblong aspect ratio in all grip sizes as well as the transverse dimensions perimetrically of the corresponding surfaces in the several grip sizes mentioned and those in between and the extra sizes smaller and larger are proportional. In other words, particularly, the distance transversely between the surfaces of the substantially oblong octagonal-like outline in section of the standard racquet handle along their distance dimension B is 90% of their distance along the dimensions A. Except for the two surfaces parallel to the playing surfaces of the racquet, the six other surfaces of the octagonal-like outline are, in standard racquets, of substantially the same perimetrical width.

In the Small grip size, these six surfaces are about 0.48 inch. In the Medium grip size they measure about 0.52 inch, and in the Large grip size they are about 0.56 inch in transverse width. The corresponding larger width surfaces in the parallel playing surmeasure about 0.62 inch, 0.64 inch and 0.68 inch respectively.

Figure 5:
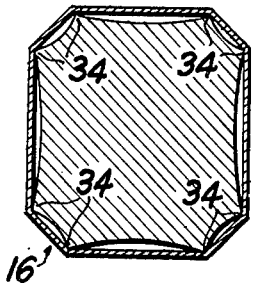
FIG. 5 is still another similar view showing a further modification.

In the construction shown in FIG. 5, the oblong aspect ratio is substantially standard and substantially similar to the previously described FIGS. 2, 3, and 4, and that is about 1 to $1\frac{1}{8}$ of the dimensions B to A. Here, all edges 34 are made acute; providing shallow but touching scollops along each surface around the perimeter of the handle, thus accentuating these edges as well as accentuating their dispostion with respect to their distance from each other by the smallness of their diagonal surfaces widths.

Figure 6:
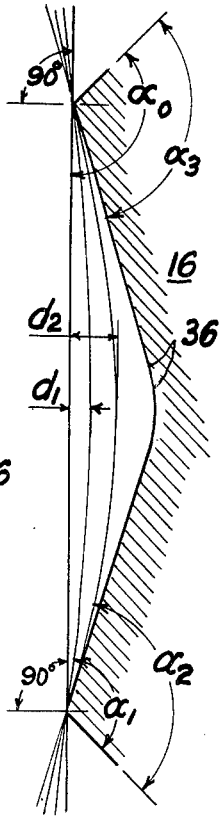
FIG. 6 is an enlarged fragmentary schematic view of one improved face and edge construction of a handle embracing the invention.

As illustrated in FIG. 6, the depth of the scollops may vary as indicated by the chordal distances $d_1$ and $d_2$, providing corresponding less and more acuteness at their ends intersection with the shown diagonal surfaces where an otherwise blunt edge of 135° would prevail in the subtended angle $\alpha_o$. The scolloped surfaced may be of "V" groove character as at 36. Here, the "V" undercut surface is shown as deeper than the arcuate ones and thus generates greater acuteness as distinguished by its subtended angle $\alpha_3$ being smaller than corresponding $\alpha_1$ and $\alpha_2$.

Figure 7:
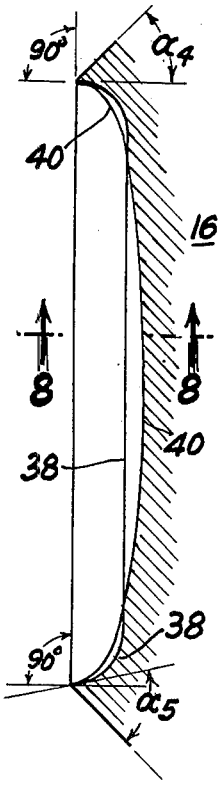
FIG. 7 is a view somewhat similar to FIG. 6 showing still another form of improved face and edge construction and configuration producing highly perceptive sense-of-feel characteristics.

FIG. 7, shows further modified forms of undercuts of substantially shallow depths yet producing a high degree of acutenes at the generated edges. A pan-shaped undercut 38 with substantially rounded out or filleted terminal configuration generates an acuteness in the order of 45° as seen at $\alpha_4$. A shallow elliptical form of undercot as illustrated at 40, can readily produce a sharp edge together with an intersecting diagonal surface of about 60° internal angle, as seen at $\alpha_5$ FIG. 8, being a longitudinal view, shows the aft or background of an undercut up to its generated edge and particularly shows a continuous and uninterrupted edge under cover and along 42.

Figure 8:
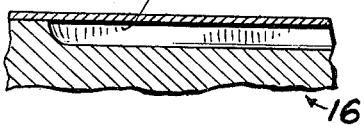
FIG. 8 is a fragmentary longitudinal section of a portion of the handle shown in FIG. 7 taken on line 8—8.
Figure 9:
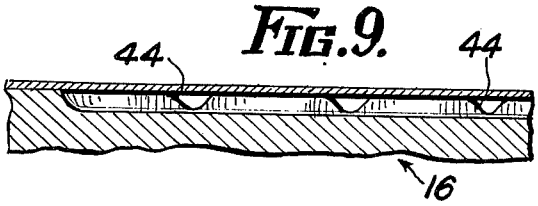
FIG. 9 is a view similar to FIG. 8 but showing a modification in construction thereof.

FIG. 9, shows an undercut of the character shown in FIG. 8, but in addition to the intensified edge, advantage is had by providing in the distal area of this undercut, a plurality of transverse grooves 44 to signal by feel-effect only in the grip and presumably instantly in the mind of the player the transmittal of sensory perception factors not only with respect to orientative disposition of the head of the racquet but also as to its distance along the playing plane from his grip.

Figure 10:
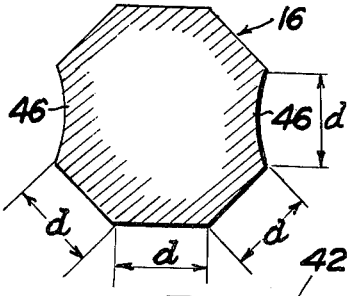
FIG. 10 is a cross-sectional view showing a still further modified form of the invention.

In FIG. 10, the cross-sctional octagonal outline of the handle is substantially square aspect character, that is, where its A to B ratio is 1 to 1. Here the distances *d* along all surfaces need not vary to as great an extent because of the undercuts are strategically on any two opposed parallel surfaces, preferably in the plane of the racquet or paddle head as shown at 46, but if otherwise preferred, these scollops may be in or along any other one or more, not all surfaces, as suits the player.

Figure 11:
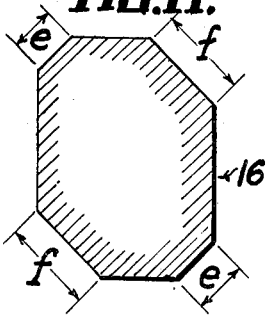
FIG. 11 is also a cross-sectional view showing yet a still further modified outline embracing the invention.

FIG. 11 shows another form of the invention wherein the two pairs of opposing diagonal surfaces are of different perimetrical widths as seen by the pair of dimensions *e* and *f*.

This configuration tends to give an orientatively askewed feeling to the player in spite of the fact that the diagonal surfaces are similarly disposed to their adjoining surfaces as are such surfaces in the standard tennis racquet handles and in their same blunt edged relationship. This modified outlines gives a highly intensified discernment to the players grip and may be used to varying degrees and incorporated in the outline in any of the described scolloped or unscolloped or undercut forms. This type of configuration is useful in correction of wrist fault swings and for developing spin onto a struck ball.

Figure 12:
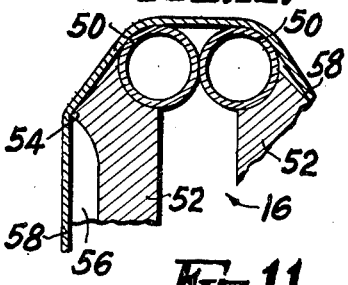
FIG. 12 is a fragmentary cross-sectional view of the invention as applied to a racquet of composite handle construction.

Refering to FIG. 12, showing the invention as applied to metallic type racquets. Some of the parts of the metallic head frame extend along the neck and continue into the handle. Such a racquet of metallic tubular members 50 may in joined fashion be engaged with wooden or preformed plastic members 52 to form a composite substantially octagonal-like cross-sectional outline simulating that of a standard tennis racquet handle. These plastic or wooden members may be joined together or may be formed of a single piece which provides the surfaces in the playing plane of the head of the racquet. The sense perceptive edges 54, are provided by recesses 56 of the type described at 38 of FIG. 7. A cover of suitable nature is provided as at 58 in tennis racquet handles but not necessarily in paddle handles.

Figure 13:
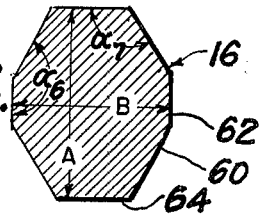
FIG. 13 is a cross-sectional view of a tennis racquet handle of eight sides and varying subtended angles between certain of the sides.

FIG. 13 shows a modified sectional outline configuration of a tennis racquet handle of substantially standard oblong apsect ratio as above described and of octagonal sides except that the sides in the plane of the head are of the smallest width whereas the other six sides may be equal and larger in width. In the instance shown, the diagonal sides or surfaces 60, subtended by angle $\alpha_6$ with the short surfaces 62, and the mid-length surfaces 64 subtended by a smaller angle $\alpha_7$ with the sides 60. This differentiation of varied edge locations and variation of grip sensed surfaces improve the sense perception of the player.

Having thus described my invention of tennis racquet or the like handles by the provision of improved sensory perception by single or dual or more improved sensory means or attributes that I prefer to call extra sensory perception, I claim:

1. In a tennis racquet of the character described having a playing face adapted for ball-striking, a longitudinal octagonal-like handle providing a pair of parallel and opposed grip-embracable longitudinal surfaces spaced apart and parallel to the plane of said ball-striking surfaces, and another pair of spaced, opposed and parallel grip-embracable longitudinal surfaces at right angles to the first mentioned pair, the transverse distance between the surfaces of the first mentioned pair of surfaces being less than 84% of the transverse distances between the surfaces of the second mentioned pair, whereupon gripping of the handle, the said difference in said transverse distances between the said pairs of surfaces is sensibly perceptive and mentally impressive upon the grip of the player, whereby the disposition of the handle and the ball-striking surface is orientatively discerned before the players stroke without observation or physical contact with the racquet other than by a single-hand grip, and also whereby the said distance difference discernment is retained throughout the players stroke and diametrically opposed scollups each extending along an edge of its containing surface.

2. A tennis racquet according to claim 1 wherein the cross-sectional outline of the said handle is of substantially octagonal configuration with eight corners and wherein at least two dimetrically opposite corners are more acute than the other six corners.

3. A tennis racquet according to claim 1 wherein the cross-sectional outline of the said handle is of substantially octagonal configuration with eight corners and wherein at least four corners in two opposite pairs are more acute than the other four corners.

4. A tennis racquet according to claim 1 wherein the cross-sectional outline of the said handle is of substantially octagonal configuration with eight corners and wherein six corners in three diametrically opposite pairs are more acute than the remaining opposite two corners.

5. A tennis racquet handle of the character described of octagonal-like cross-sectional outline comprising a plurality of pairs of substantially diametrically opposite surfaces, the surfaces of each pair being of similar width and forming obtuse edges of substantially 135° subtended angle defining said outline, a single longitudinal flute-like depression in each surface of at least one of said pairs of surfaces, said flute-like depressions being oppositely and so disposed in their respective surfaces as to form at least two diametrically opposite continuously longitudinal edges more acute than said 135° edges, the edges of adjacent pairs of surfaces of said octagonal outline being of different distances apart, whereupon gripping of the handle, the orientative disposition of the said more acute edges are perceivable by only the sense of feel in the grip of a player.

6. A tennis racquet handle in accordance with claim 5, wherein the said flute-like depressions each, spans its containing surface from edge to edge and forms at their terminations four edges each more acute than said obtuse edges along diametrically opposite edges of said octagonal-like outline.

7. A tennis racquet handle in accordance with claim 5, wherein each of the diagonal pairs of surfaces of said octagonal-like outline is of different transverse width than that of its adjacent pair of opposite surfaces.

8. A tennis racquet handle in accordance with claim 5, wherein all of the said surfaces are fluted edge to edge, forming edges acuter than 135° of subtended angle.

9. A tennis racquet in accordance with claim 5, wherein only one of said pairs of opposite surfaces are of different perimetrical width than the other pairs.

* * * * *

UNITED STATES PATENT OFFICE

CERTIFICATE OF CORRECTION

Patent No. 4,072,312 Dated Feb. 7, 1978

Inventor(s) Benjamin Kahn

It is certified that error appears in the above-identified patent and that said Letters Patent are hereby corrected as shown below:

Column 3, line 54, "along" should read -- alone --.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*